US005381992A

United States Patent [19]

Lohausen

[11] Patent Number: 5,381,992

[45] Date of Patent: Jan. 17, 1995

[54] MOUNTING DEVICE FOR AN ARTICULATED-ARM AWNING

[75] Inventor: Viktor Lohausen, Oberheinriet, Germany

[73] Assignee: Technolizenz Establishment, Triesen, Liechtenstein

[21] Appl. No.: 98,289

[22] PCT Filed: Dec. 12, 1991

[86] PCT No.: PCT/EP91/02383

§ 371 Date: Aug. 4, 1993

§ 102(e) Date: Aug. 4, 1993

[87] PCT Pub. No.: WO92/14009

PCT Pub. Date: Aug. 20, 1992

[30] Foreign Application Priority Data

Feb. 6, 1991 [DE] Germany ..... 4103474

[51] Int. Cl.[6] ..... A47K 1/00

[52] U.S. Cl. ..... 248/220.2; 160/903

[58] Field of Search ..... 248/220.2, 222.2, 224.3, 248/225.2, 227, 273, 205.1; 160/22, 66, 67, 903

[56] References Cited

U.S. PATENT DOCUMENTS 4,205,815 6/1980 Sauer et al. ..... 248/222.2 X
5,092,546 3/1992 Wolfbauer ..... 248/222.2 X

FOREIGN PATENT DOCUMENTS 1409816 10/1975 United Kingdom ..... 248/273
1017329 11/1991 WIPO ..... 160/22

*Primary Examiner*—Ramon O. Ramirez

[57] ABSTRACT

A mounting device for an articulated-arm awning has a bracket, a bearing block for at least one articulated arm and means for mounting a fabric shaft attachable to the mounting tube/hollow section. The mounting tube/hollow section includes a first chamber, a second chamber above the first chamber for holding an adjusting mechanism, a back having a continuous stepped hole for a retaining bolt for attaching the bearing block and at least one approximately hook-shaped mounting device. The bracket has at least one hook-shaped mounting device complementary to the mounting device on the mounting tube/hollow section.

10 Claims, 2 Drawing Sheets

MOUNTING DEVICE FOR AN ARTICULATED-ARM AWNING

BACKGROUND OF THE INVENTION

1. Field of the Invention

The invention relates to an articulated-arm awning having a bracket and a mounting tube/hollow section which can be attached thereto and is intended for holding at least one bearing block for at least one articulated arm and means for mounting a fabric shaft.

2. Relevant Prior Art

Articulated-arm awnings which can be attached to wall brackets by means of fitting sections or holders are sufficiently well known. Thus, for example, DE 25 14 941 C3 describes an articulated-arm awning having a cantilever awning box which is attached to wall brackets via wall holders.

However, attempts have long been made to combine as many parts of the articulated-arm awning as possible into a unit.

Thus, for example, DE 37 08 155 C2 describes an articulated-arm awning having a central fixing section which serves for holding the bearings for the articulated arms and for holding all adjusting mechanisms.

On the other hand, the attachment of articulated-arm awnings to buildings still involves a considerable amount of work.

SUMMARY OF THE INVENTION

It is the object of the invention to combine these two requirements, i.e. to provide a mounting device which both facilitates the attachment of the articulated-arm awning and permits the combination of the adjusting mechamisms and their attachment to a component.

It must not be forgotten that the entire construction must be stable and nondeformable and should nevertheless preferably consist of only a few parts.

This object of the invention is achieved if the mounting tube/hollow section has, above a first, preferably closed chamber, a second chamber for holding an adjusting mechanism, a continuous stepped hole for receiving a retaining bolt for the attachment of the bearing block is provided on the back of said mounting tube/hollow section, if furthermore the mounting tube/hollow section has at least one approximately hook-like mounting device on its back, and the bracket has at least one complementary hook-like mounting device.

DESCRIPTION OF THE DRAWINGS

The invention is now illustrated in detail with reference to embodiments in conjunction with the attached drawings.

In the drawings.

DETAILED DESCRIPTION OF PREFERRED EMBODIMENTS

Figure 1:
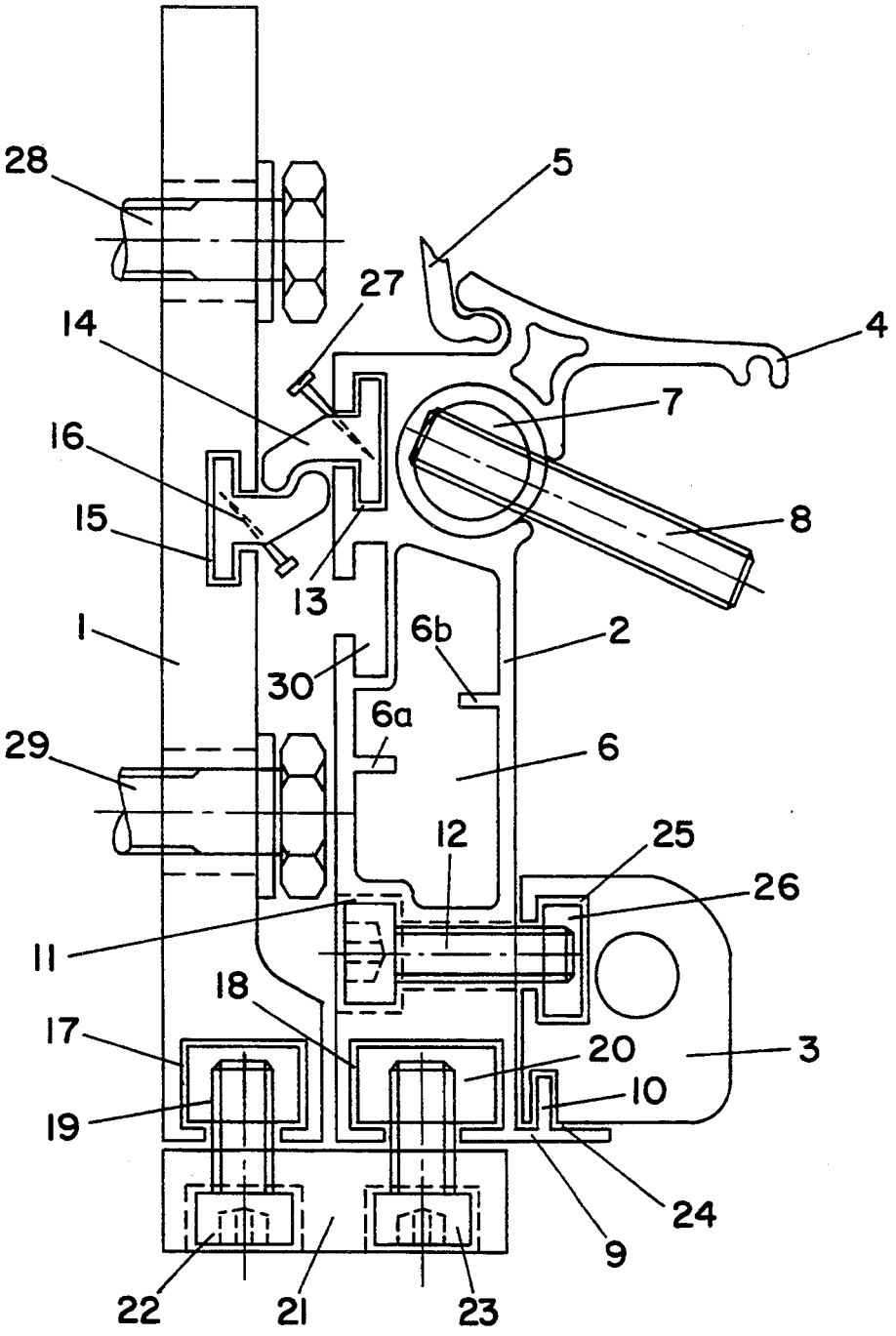
FIG. 1 shows a first embodiment of a mounting device for articulated-arm awnings according to the invention and FIG. 2 shows a somewhat simplified embodiment of the mounting device.

FIG. 1 shows a first embodiment of the novel mounting device for articulated-arm awnings. It consists of a bracket 1 which can be attached, for example, to the wall and to which a mounting tube/hollow section 2 is attached.

Mounting tubes and hollow sections are sufficiently well known per se. Here, however, a combination of the two conventional components is employed, serving both for attachment to the bracket and for attachment of other components of an articulated-arm awning.

Thus, it is possible to recognize, for example, a bearing block 3, to which an articulated arm (not shown) could be attached. Attachment means 4 are also indicated, on which further parts of an articulated-arm awning, such as, for example, the component indicated merely as the lower end of a housing 5, are to be seen. These parts are of conventional design and therefore require no further explanation in connection with the present invention.

Firstly, the mounting tube/hollow section 2 has a large chamber 6 which is located approximately in the center and into which stiffening ribs **6*a* and 6*b*** can be drawn to provide rigidity. Further stiffening ribs may also be provided if thought to be necessary.

A round chamber 7 for a joint mechanism or tilting mechanism is provided above the chamber 6. This chamber 7 is open in front and serves for mounting a threaded bolt 8 which can be connected, for example, to a tilting mechanism. Constructions of this type are likewise generally customary and require no further explanation here.

The mounting tube/hollow section 2 has, at its lower end, a horizontal, forward-projecting strip 9 which has a narrow web 10 which points vertically upward and whose significance is still to be explained. In addition, the mounting tube/hollow section 2 has, below the chamber 6, a stepped hole 11 into which a retaining bolt for the bearing block can be inserted.

Furthermore, a chamber which widens from the outside inward is provided in the upper region on the back of the mounting tube/hollow section. This chamber 13 preferably has a T-shaped cross-section. A hook 14, preferably a hook-like strip 14 which can be pushed into this chamber, is inserted into the chamber. This hook-like strip 14 is bent downward.

Similarly, a chamber 15 of this type which widens from the outside inward and preferably has a T-shaped cross-section is arranged in the bracket 1, and a hook 16, preferably a hook-like strip 16, can be pushed into said chamber 15. These two hook-like strips 14 and 16 thus have, on their back, a cross-section corresponding to the cross-section of the chamber 13 or 15 and, on their front, in each case the corresponding hook-like strip 14 or 16.

Furthermore, grooves 17 and 18 which have an approximately T-shaped cross-section and into which the threaded nuts 19 and 20 can be inserted are provided at the bottom of the bracket 1 or of the mounting tube/hollow section 2. A retaining strip 21 which preferably has stepped holes provided with an internal thread for receiving retaining bolts 22 and 23 is provided for attaching the two parts to one another.

In this context, it should be mentioned that the bearing block has, in its lower surface, a narrow slot 24 into which the web 10 serving for attachment exactly fits. Moreover, the bearing block 3 contains, on its back, a T-shaped groove 25 which may be open continuously or only on one side and into which a threaded nut 26 can be inserted, into which nut the retaining bolt 12 can then be screwed for fixing the bearing block.

Finally, two retaining bolts 28 and 29 which serve for attaching the articulated-arm awning to the wall are also indicated on the bracket 1.

A few fundamentals must be stated in this connection since the novel mounting device for articulated-arm awnings is shown in principle only in a sectional view. It is clear that, depending on the length of the awning, one or more brackets 1 can be used. It is also clear that the brackets themselves may be of any width.

Similarly, one or more mounting tube/hollow sections will of course be used. This means that the retaining strip 21, too, can extend over the length of a bracket and of a mounting tube/hollow section, and that it can also extend over the total length of a plurality of brackets and a plurality of mounting tube/hollow sections. Accordingly, a required number of retaining bolts 22 and 23 will be provided. Where more than one articulated arm is provided, a corresponding number of bearing blocks is also provided. This also applies to the tilting mechanism, which is indicated here only by the threaded bolt.

On the other hand, it is also possible for the bracket 1 and the retaining strip 21 to consist of one piece. This would then dispense with the T-shaped groove 17, the nut 19 and the retaining bolt 22.

Finally, the mounting tube/hollow section has, on its back, also a further chamber 30 having a preferably T-shaped cross-section, into which it would then be possible to insert a hook-like strip 14 having a hook strip angled upward. The hook-like strip 16 would then have to possess a hook strip angled downward.

Figure 2:
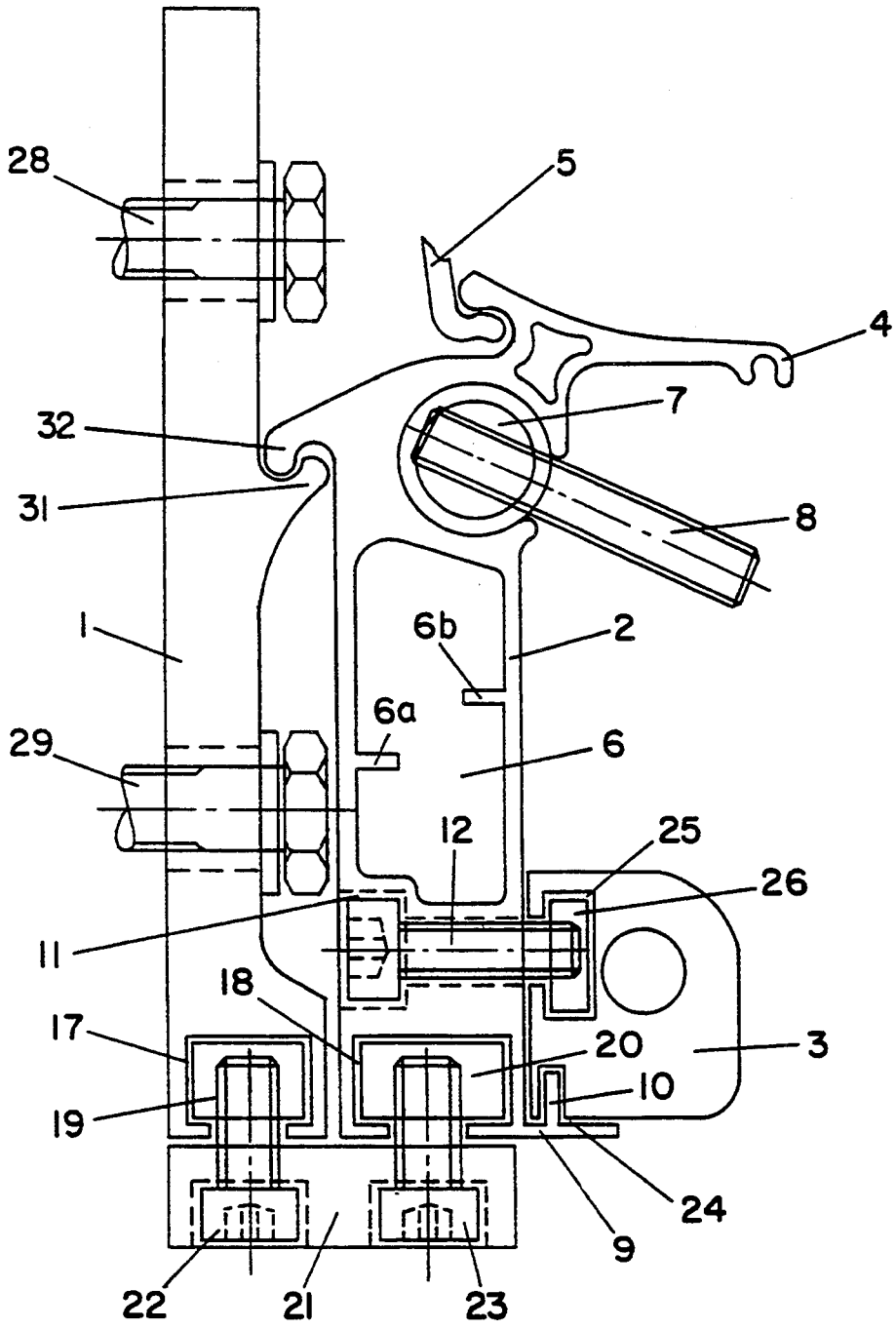

FIG. 2 shows a further embodiment of the novel mounting device for articulated-am awnings, in which identical parts are provided with the same reference symbols, so that the explanation given in connection with FIG. 1 essentially also applies to FIG. 2.

Instead of the chambers 13 and 15 and the hook-like strips 14 and 15, only hook-like strips are now provided. The bracket 1 has, on its front, an upward-pointing hook-like strip 31, while the mounting tube/hollow section 2 has, on its back, a complementary hook-like strip 32 which is angled downward and can be hooked into the hook-like strip 31.

The mounting device is now mounted as follows: First, the hook-like strips 14 and 16 are inserted into the grooves 13 and 15 of the mounting tube/hollow section 2 or of the bracket 1, and the mounting tube/hollow section 2 is suspended thereon. Thereafter, the retaining strip 21 is mounted from below with its retaining bolts 22 and 23, and these bolts are screwed into the nuts 18 and 19 and are tightened so that the two hook-like strips 14 and 16 fit tightly together. The cross-section of the hook-like strips can preferably be chosen so that a clamping effect is achieved.

The attachment of the bearing block or of the bearing blocks, which of course must be performed before attaching the mounting tube/hollow section 2 to the bracket 1, is in principle clear from the drawing. The bearing block 3 is mounted with its slot 24 on the web 10, after which the nut 26 is pushed into the T-shaped groove 25 and the retaining bolt 12 is screwed into the nut 26 and is tightened. The bearing block 3 then fits firmly on the mounting tube/hollow section and cannot move.

The information given for the mounting of the mounting device according to FIG. 1 applies in general terms also to the mounting device according to FIG. 2, the mounting here being substantially simpler since the mounting tube/hollow section 2 need merely be hooked with its hook-like strip 32 into the corresponding hook-like strip 31 of the bracket 1. The further procedure corresponds to the description given in connection with FIG. 1.

The actual articulated-arm awning, for example a cassette awning or an articulated-arm awning having only one articulated arm, can now be attached to the mounting device mounted in this manner.

Owing to this mounting device being oriented essentially in a vertical direction, an awning which is relatively flat in the horizontal direction is obtained, this being a particular advantage in many cases.

The invention thus provides a mounting device for an articulated-arm awning, which device is particularly suitable owing to its construction. The mounting tube/-hollow section and the bearing block or the bearing blocks as well as the hook-like strips inserted into chambers having T-shaped cross-sections can be delivered in preassembled form. Furthermore, both the stepped hole 11 and the holes for the retaining bolts 22 and 23 in the retaining strip 21 can be provided with at least partial internal threads so that the retaining bolts can be screwed in to such an extent that they no longer fall out. In practice, the mounting tube/hollow section can thus be simply suspended and screwed on at the place of mounting. The object of the invention is thus achieved.

I claim:

1. A mounting device for an articulated-am awning, comprising:

a bracket, a mounting tube/hollow section attachable to said bracket, a bearing block for at least one articulated arm attachable to said mounting tube/-hollow section and means for mounting a fabric shaft attachable to said mounting tube/hollow section, wherein said mounting tube/hollow section comprises a first chamber, a second chamber above said first chamber for holding an adjusting mechanism, a back having a continuous stepped hole for a retaining bolt for attaching said bearing block, and at least one approximately hook-shaped first mounting device, and said bracket comprises at least one hook-shaped second mounting device complementary to said first mounting device.

2. A mounting device according to claim 1, wherein said first mounting device(s) and said second mounting device(s) are firmly connected to said mounting tube/-hollow section and said bracket, respectively.

3. A mounting device according to claim 2, wherein said first mounting device(s) and said second mounting device(s) are formed as a single piece with said mounting tube/hollow section and said bracket, respectively.

4. A mounting device according to claim 1, wherein said mounting tube/hollow section has on said back at least one chamber that widens from the outside inward into which a hook having a complementary base in insertable, and said bracket has, opposite said mounting tube/hollow section, at least one chamber that widens from the outside inward into which a hook having a complementary base is insertable.

5. A mounting device according to claim 4, wherein said mounting tube/hollow section has an upper end and said at least one chamber on said mounting tube/-hollow section comprises at least one T-shaped chamber in the vicinity of said upper end into which a hook having a complementary T-shaped base is insertable, and said at least one chamber in said bracket comprises at least one T-shaped chamber into which a hook having a complementary T-shaped base is insertable.

6. A mounting device according to claim 4, wherein said at least one chamber in said mounting tube/hollow section widens in an inward direction in an approximately swallow tail manner into which a hook having a complementary base is insertable, and said at least one chamber in said bracket widens in an inward direction in an approximately swallow tail manner into which a hook having a complementary base is insertable.

7. A mounting device according to claim 1, wherein said first chamber comprises a closed chamber.

8. A mounting device according to claim 1, wherein said bracket and said mounting tube/hollow section each have a lower surface having an approximately T-shaped groove for receiving threaded nuts, a retaining strip provided with holes is arranged at said lower surface, and said bracket and said mounting tube/hollow section are connectable to one another by retaining bolts that are insertable into said retaining strip and screwable into corresponding threaded nuts.

9. A mounting device according to claim 1, wherein said mounting tube/hollow section has a lower end having a projecting strip with an upward-pointing web.

10. A mounting device according to claim 9, wherein said bearing block has a lower surface having a slot for receiving said web and a back having a T-shaped groove for receiving a threaded nut for attaching said bearing block to said mounting tube/hollow section by means of a retaining bolt.

* * * * *